US007411554B2

(12) United States Patent
Jung et al.

(10) Patent No.: US 7,411,554 B2
(45) Date of Patent: Aug. 12, 2008

(54) MIMO ANTENNA OPERABLE IN MULTIBAND

(75) Inventors: Chang-won Jung, Yongin-si (KR); Byung-tae Yoon, Yongin-si (KR); Young-eil Kim, Yongin-si (KR); Se-hyun Park, Yongin-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 11/637,663

(22) Filed: Dec. 13, 2006

(65) Prior Publication Data

US 2008/0018539 A1 Jan. 24, 2008

(30) Foreign Application Priority Data

Jul. 20, 2006 (KR) ..... 10-2006-0068208

(51) Int. Cl.
*H01Q 1/38* (2006.01)
*H01Q 3/24* (2006.01)

(52) U.S. Cl. ..... 343/700 MS; 343/876

(58) Field of Classification Search ..... 343/700 MS, 343/702, 754, 876, 850, 853, 895
See application file for complete search history.

(56) References Cited

U.S. PATENT DOCUMENTS 5,511,238 A * 4/1996 Bayraktaroglu ..... 455/81
6,061,024 A * 5/2000 McGirr et al. ..... 343/700 MS
6,806,843 B2 * 10/2004 Killen et al. ..... 343/795

* cited by examiner

*Primary Examiner*—Hoang V Nguyen
(74) *Attorney, Agent, or Firm*—Sughrue Mion, PLLC

(57) ABSTRACT

A multiple-input multiple-output (MIMO) antenna operable in a multiband includes a plurality of antenna elements each including a radiator radiating electromagnetic waves, a ground connected to the radiator, at least one switching element mounted in an area of lengthwise direction of the radiator and short-circuiting or opening the area of the radiator.

16 Claims, 6 Drawing Sheets

MIMO ANTENNA OPERABLE IN MULTIBAND

CROSS-REFERENCE TO RELATED APPLICATIONS

This application claims priority from Korean Patent Application No. 2006-68208 filed on Jul. 20, 2006, in the Korean Intellectual Property Office, the disclosure of which is incorporated herein by reference in its entirety.

BACKGROUND OF THE INVENTION

1. Field of the Invention

Apparatuses consistent with the present invention relate to a multiple-input multiple-output (MIMO) antenna operable in a multiband. More particularly, the present invention relates to a MIMO antenna which is provided in a miniaturized size and can operate in a multiband.

2. Description of the Related Art

With the demand for multimedia services of high quality using wireless mobile communication technology, a next-generation wireless transmission technique is required to deliver massive data at a higher rate with a lower error rate.

To respond to this, a multiple-input multiple-output (MIMO) antenna has been suggested. The MIMO antenna carries out the MIMO operation by arranging a plurality of antenna elements in a specific structure. The MIMO antenna makes the overall radiation pattern sharp and transmits the electromagnetic waves farther by combining the ration pattern and the radiation power of the antenna elements.

Accordingly, it is possible to increase the data transfer rate in a specific range or expand the system range for a specific data transfer rate. The MIMO antenna, which is the next-generation mobile communication technique applicable to various mobile terminals and repeaters, is attracting attention as a new solution to overcome the limited transmission quantity of mobile communications.

However, since the MIMO antenna requires smaller antenna elements to mount them in a small terminal, it is hard to implement using a conventional antenna.

Thus, a small antenna element is needed that can implement the MIMO system in accordance with the miniaturization of the terminal.

In the mean time, development of various wireless communication services available using the wireless terminal are under way such as GSM, PSC, WLAN, WiBro, and Bluetooth. A reconfigurable antenna is required to receive the radio communication services using a single wireless terminal.

To this end, an antenna having a very wide frequency band covering a plurality of service bands or a multiband antenna operating in double or multiple frequency bands is under development.

By implementing the MIMO antenna by arranging a plurality of antennas operable in the multiple frequency bands, an antenna can operate in various service bands and can also transmit data efficiently.

However, the size of the antenna operating in the wide frequency band can be reduced, but may face noise and interference caused by the unused band. In the case of the MIMO antenna which arranges the plurality of antennas, this problem can be more serious.

In contrast, the multiband antenna suffers less noise and less interference than the antenna operating in the wide frequency band, but its size is greater than the antenna operating in one band. As a result, when the plurality of the multiband antennas are arranged, the size of the MIMO antenna increases.

SUMMARY OF THE INVENTION

The present invention has been provided to address the above-mentioned and other problems occurring in the conventional arrangement, and an aspect of the present invention is to provide a MIMO antenna which is provided in a miniaturized size and can operate in multiple service bands.

According to an aspect of the present invention, there is provided a multiple-input multiple-output (MIMO) antenna operable in a multiband including a plurality of antenna elements each comprising a radiator radiating electromagnetic waves, a ground connected to the radiator, and at least one switching element mounted in an area of a lengthwise direction of the radiator and short-circuiting or opening the area of the radiator.

The radiator may include a feeding part formed in a long strip shape in a first direction of the radiator, and a plate-shaped radiating plate connected to a first end of the feeding part.

The radiation plate may include a first radiation plate which is formed in a strip shape and connected to the first end of the feeding part in a cross direction of the feeding part, and a second radiation plate which is formed in a rectangular shape and apart from the first radiation plate at an interval.

A first side of the first radiation plate and a first side of the second radiation plate may be interconnected by the switching element, and short-circuited or opened according to an on state or an off state of the switching element.

When the switching element is turned on to electrically short-circuit the first radiation plate and the second radiation plate, the radiator may operate in a low frequency band compared to the off state of the switching element. When the switching element is turned off to electrically open the first radiation plate and the second radiation plate, the radiator may operate in a high frequency band compared to the on state of the switching element.

The radiator may include a meander line part which is bent in a zigzag pattern.

The switching element may be mounted on a first side of the circuit board along the lengthwise direction of the meander line part, and the first side of the meander line part may be short-circuited or opened according to the on state or off state of the switching element.

When the switching element is turned on to electrically short-circuit the first side of the meander line part, the radiator may operate in a low frequency band compared to the off state of the switching element. When the switching element is turned off to electrically open the first side of the meander line part, the radiator may operate in a high frequency band compared to the on state of the switching element.

The switching element may be a PIN diode.

The MIMO antenna may further include a switching controller which turns on the switching element by applying a voltage over a certain level to the switching element.

A plurality of switching elements may be arranged at intervals in the lengthwise direction of the radiator.

The grounds of the antenna elements may be formed as one.

The radiators of the antenna elements may be arranged at intervals.

The radiator may be mounted on a first side of a circuit board, and the ground may be mounted on a second side of the circuit board.

A matching part may be formed on the ground and the matching part may extend from the ground to a distance and is bent to one side.

The matching part may be electrically connected to the first radiation plate through a via hole.

The switching elements of the antenna elements may be turned on or off at the same time.

BRIEF DESCRIPTION OF THE DRAWING

These and other aspects of the present invention will become more apparent and more readily appreciated from the following description of exemplary embodiments thereof, with reference to the accompanying drawings, in which.

DETAILED DESCRIPTION OF THE EXEMPLARY EMBODIMENTS OF THE PRESENT INVENTION

Figure 1:
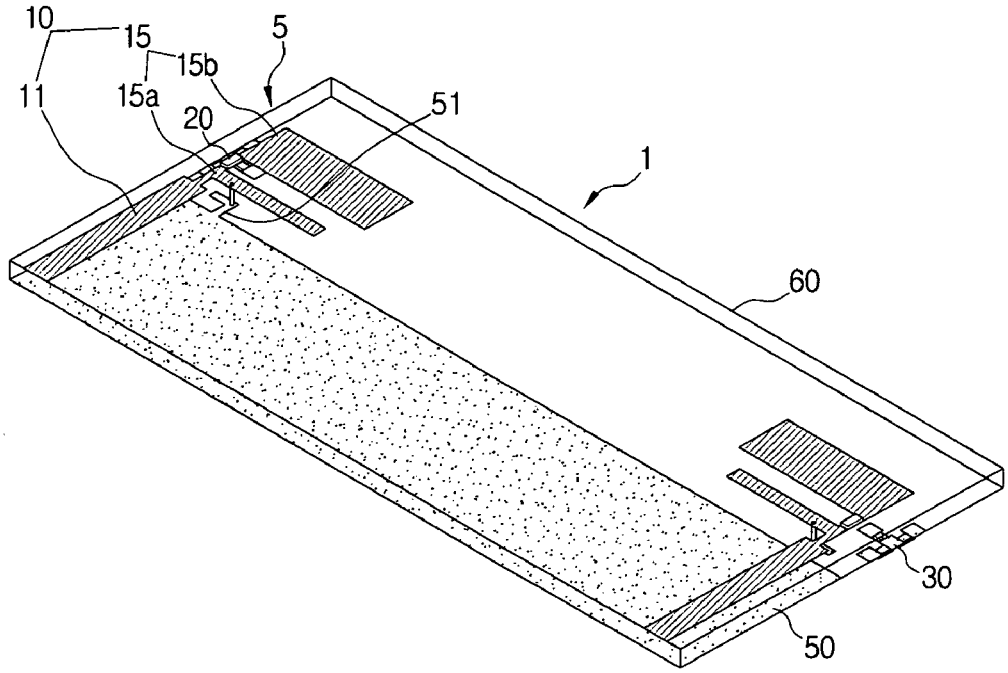
FIG. 1 is a perspective view of a MIMO antenna according to an exemplary embodiment of the present invention.

Certain exemplary embodiments of the present invention will now be described in greater detail with reference to the accompanying drawings.

In the following description, the same drawing reference numerals are used to refer to the same elements, even in different drawings. The matters defined in the following description, such as detailed construction and element descriptions, are provided as examples to assist in a comprehensive understanding of the invention. Also, well-known functions or constructions are not described in detail, since they would obscure the invention in unnecessary detail.

Figure 2:
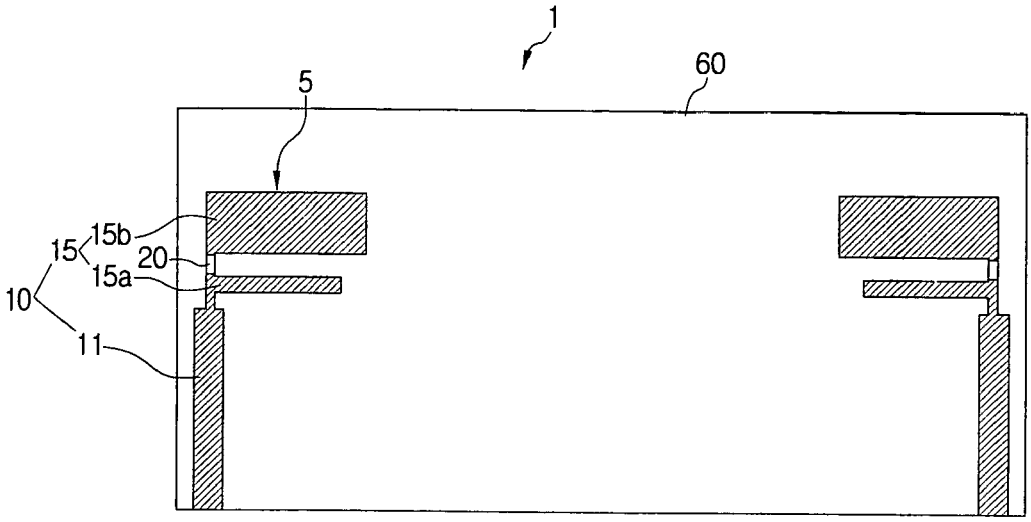
FIG. 2 is a front view of the MIMO antenna of FIG. 1.
Figure 3:
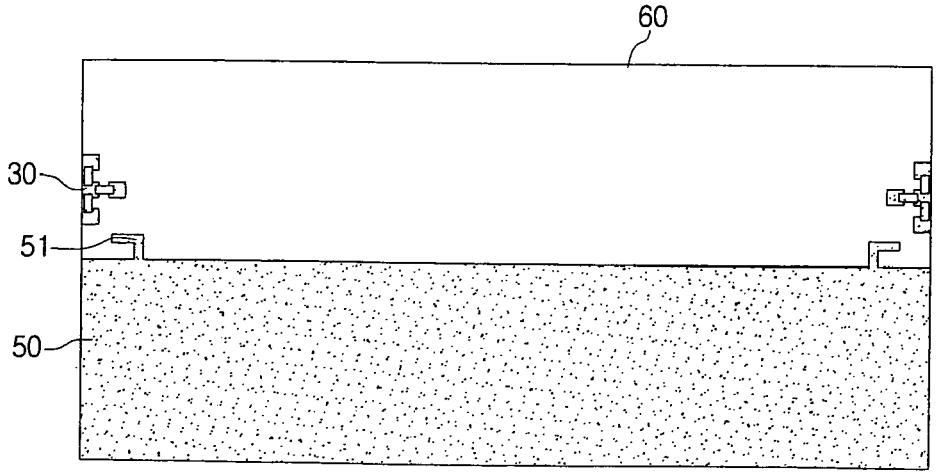
FIG. 3 is a rear view of the MIMO antenna of FIG. 1.

FIG. 1 is a perspective view of a MIMO antenna according to an exemplary embodiment of the present invention, FIG. 2 is a front view of the MIMO antenna of FIG. 1, and FIG. 3 is a rear view of the MIMO antenna of FIG. 1.

The MIMO antenna 1 includes a pair of antenna elements 5. Each antenna element 5 includes a ground 50, a radiator 10, a PIN diode 20, and a switching controller 30.

The antenna element 5 is mounted on a circuit board 60 at an interval. The ground 50 of the antenna element 5 is formed on one side of the circuit board 60, and the radiator 10 of the antenna element 5 is formed on the other side of the circuit board 60.

The grounds 50 of the antenna elements 5 are interconnected to form a single ground 50 and are electrically connected to the radiators 10 of the antenna elements 5 which are arranged on the other side of the circuit board 60. The ground 50 occupies about half of the circuit board 60.

A pair of matching parts 51 are formed at positions corresponding to the radiators 10 of the antenna elements 5. The matching parts 51 extend from the ground 50 toward the circuit board 60 where the ground 50 is not formed and are then bent in a '¬'shape. Free ends of the matching parts 51 symmetrically face the outside of the circuit board 60. The matching parts 51 are electrically connected with the radiator 10 of the antenna element 5 through a via hole. The matching parts 51 enhance the frequency matching by improving a return loss of the MIMO antenna 1.

The radiator 10 of the antenna element 5 is attached on the other side of the circuit board 60 in a patch antenna shape. The radiator 10 includes a feeding part 11 formed in a straight strip shape and a radiation plate 15 connected to one end of the feeding part 11. In an exemplary embodiment, the length of the feeding part 11 substantially equals the length of the ground 50, and the feeding part 11 is placed to correspond to the region where the ground 50 is formed.

The radiation plate 15 of the antenna element 5 includes a first radiation plate 15*a* which is connected to one end of the feeding part 11 and extends in the cross direction of the feeding part 11 in a strip shape, and a second radiation plate 15*b* which is apart from the first radiation plate 15*a* at an interval in a rectangular shape. The first radiation plate 15*a* is placed to correspond to the matching part 51 of the ground 50 and is electrically connected to the matching part 51 through a via hole. The second radiation plate 15*b* is longer and wider than the first radiation plate 15*a*. The first radiation plate 15*a* and the second radiation plate 15*b* of the antenna element 5 are arranged so that their free ends face each other.

Since the first radiation plate 15*a* and the second radiation plate 15*b* of the antenna element 5 are formed in a plate shape, rather than a line, they do not have to be long. Accordingly, the size of the antenna element 5 can be miniaturized.

The PIN diode 20 mounted on the radiator 10 interconnects the first radiation plate 15*a* with the second radiation plate 15*b*. The PIN diode 20 aligns with the feeding part 11. The PIN diode 20 electrically short-circuits or opens the first radiation plate 15*a* and the second radiation plate 15*b* according to a voltage supplied from the switching controller 30.

In general, the PIN diode 20 is turned on when a voltage over a certain level is applied. In the exemplary embodiment of the present invention, the PIN diode 20 intrinsically has 1Ω of series resistance and is turned on when the voltage over 1V is received. Hence, the first radiation plate 15*a* and the second radiation plate 15*b*, interconnected through the PIN diode 20, are short-circuited and thus the length of the radiator 10 equals the total length covering the feeding part 11, the first radiation plate 15*a*, and the second radiation plate 15*b*.

Note that the total length of the radiator 10 is changeable according to the desired design and that the operating frequency of the MIMO antenna 1 varies depending on the length of the radiator 10. For instance, when the total length of the radiator 10 covering the feeding part 11, the first radiation plate 15*a*, and the second radiation plate 15*b* is 56.5 mm, the MIMO antenna 1 has the resonance point in 2.4 GHz frequency band. Since 2.4 GHz belongs to frequency bands of IEEE 802.11b standard (WLAN) and the Bluetooth communications, the MIMO antenna 1 is applicable for the WLAN or the Bluetooth. By extending the total length of the radiator 10 to a degree, the MIMO antenna 1 can be used for WiBro services in 2.3 GHz frequency band.

By contrast, when no voltage is applied to the PIN diode 20, the series resistance becomes 10 kΩ and the PIN diode 20 is turned off. Thus, the PIN diode 20 opens the first radiation plate 15*a* and the second radiation plate 15*b* and thus the length of the radiator 10 is equal to the length from the feeding part 11 to the first radiation plate 15*a*. Note that the lengths of the feeding part 11 and the first radiation plate 15*a* are changeable according to the desired design. When the length from the feeding part 11 to the first radiation plate 15*a* is 14.65 mm, the MIMO antenna 1 has the resonance point of 5.3 GHz.

When resonating in 5.3 GHz frequency band, the MIMO antenna 1 can be used for the WLAN of IEEE 802.11a standard.

As such, when the PIN diode 20 is turned on and the length of the radiator 10 is extended, the MIMO antenna 1 has the relatively low resonance point. When the PIN diode 20 is turned off, the length of the radiator 10 shortens and the MIMO antenna 1 has a relatively high resonance point. As a result, the single MIMO antenna 1 can transmit and receive signals in two service bands.

As the voltage 5V, which is applied when the PIN diode 20 is turned on, is mostly used for the wireless terminal, the cost reduction and the simplified circuit can be achieved without a separate power supply source.

Figure 4:
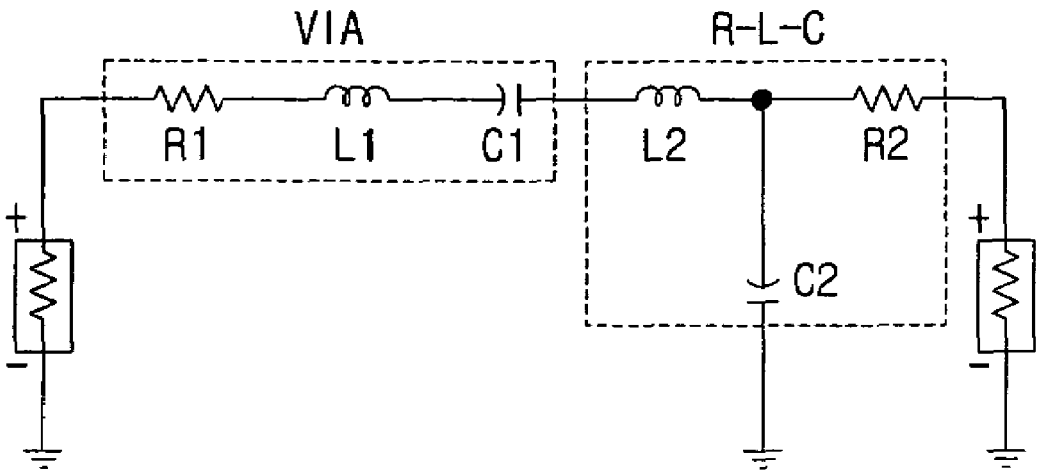
FIG. 4 is an equivalent circuit diagram of a switching controller.

The switching controller 30, which turns on and off the PIN diode 20, is mounted on the side where the ground 50 is mounted on the circuit board 60 and arranged at both ends in the lengthwise direction of the ground 50 to lie adjacent to the matching part 51. The switching controller 30 applies the voltage of 0V or 5V to the PIN diode 20. When the switching controller 30 applies the voltage 0V, the PIN diode 20 is turned off. When the voltage 5V is applied, the PIN diode 20 is turned on. The switching controller 30 is implemented as a RLC circuit;

FIG. 4 is an equivalent circuit diagram of the switching controller 30.

In FIG. 4, the via hole connecting the PIN diode 20 to the switching controller 30 is represented by an inductor, and the switching controller 30 consists of a resistor, an inductor, and a capacitor. It is required that the voltage supplied from the switching controller 30 should not affect the resonant frequency of the MIMO antenna 1. For doing so, the via hole and the switching controller 30 are designed to have proper resistance, inductance, and capacitance to generate high isolation in the corresponding resonant frequency. Thus, the power supply from the switching controller 30 does not affect the resonant frequency of the MIMO antenna 1.

Figure 5A:
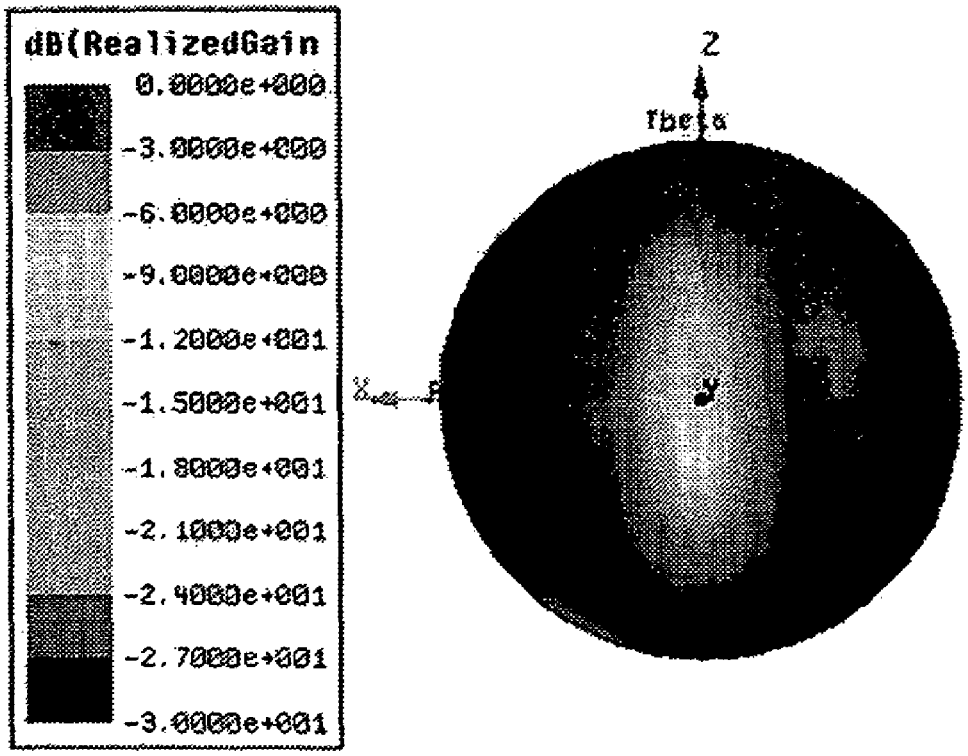
FIG. 5A is a diagram showing a radiation pattern of the MIMO antenna according to an exemplary embodiment of the present invention.
Figure 5B:
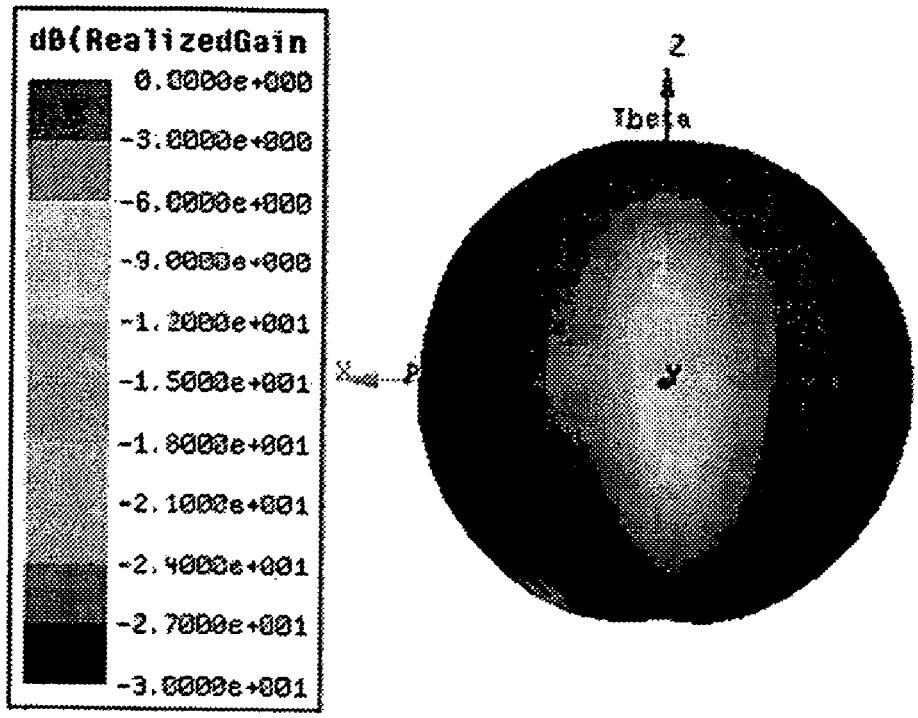
FIG. 5B is a diagram showing a radiation pattern of an antenna element of the MIMO antenna.

FIG. 5A shows a radiation pattern of the MIMO antenna 1 according to an exemplary embodiment of the present invention, and FIG. 5B shows a radiation pattern of the antenna element 5 of the MIMO antenna 1.

As shown in FIG. 5A, the MIMO antenna 1 produces the omnidirectional radiation pattern which is the property of the monopole antenna, and has the gain of 2 dB.

As shown in FIG. 5B, the antenna element 5 constructing the MIMO antenna 1 not only produces the omnidirectional radiation pattern but also has the gain of 0 dB.

In conclusion, the MIMO antenna 1 acquires the omnidirectionality and the good gain.

As constructed above, when the PIN diode 20 is turned on, the MIMO antenna 1 operates in the relatively low frequency band since the length of the radiator 10 is extended. When the PIN diode 20 is turned off, the MIMO antenna 1 operates in the relatively high frequency band since the length of the radiator 10 is shortened. In the operation of the MIMO antenna 1, the operating frequencies of the antenna elements 5 need to be equal. Accordingly, the PIN diodes 20 mounted on the antenna elements 5 need to turn on and off at the same time.

Figure 6:
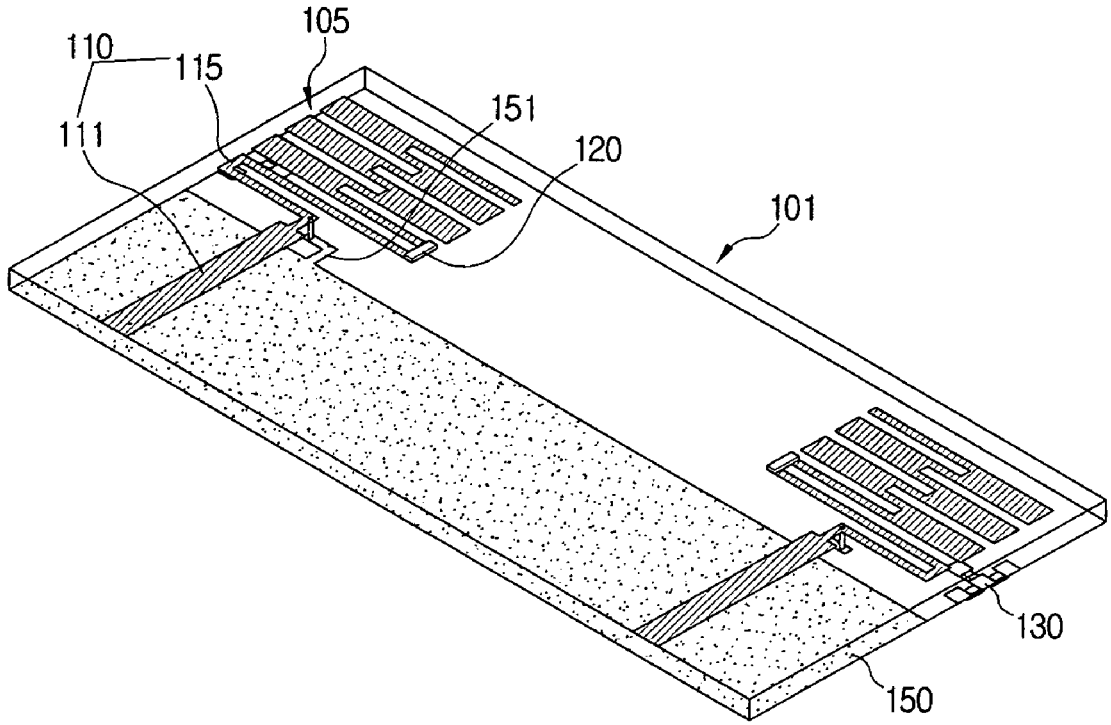
FIG. 6 is a perspective view of a MIMO antenna according to another exemplary embodiment of the present invention.

FIG. 6 is a perspective view of a MIMO antenna according to another exemplary embodiment of the present invention.

The MIMO antenna 101 includes a pair of antenna elements 105. Each antenna element 105 includes a ground 150, a radiator 110, a PIN diode 120, and a switching controller 130. Herein, the ground 150, the PIN diode 120, and the switching controller 130 are constructed the same as the ground 30, the PIN diode 20, and the switching controller 30, respectively, of FIGS. 1, 2, and 3, respectively, and thus their further descriptions shall be omitted for brevity.

The radiator 110 of the antenna element 105 includes a meander line part 115 bent several times along the lengthwise direction, and a feeding part 111 formed in a straight strip shape, as shown in FIG. 6. The length of the feeding part 111 is substantially equal to the length of the ground 150. The feeding part 111 is placed to correspond to the area the ground 150 is formed on.

The meander line part 115 is extended from an end of the feeding part 111 to a certain distance and is bent in a zigzag pattern several times. The end of the meander line part 115, facing the feeding part 111, is electrically connected to the matching part 151 of the ground 150 through a via hole.

A PIN diode 120 is mounted in an area of the meander line 115 in the lengthwise direction. The PIN diode 120 electrically short-circuits or opens the meander lines 115 coupled to ends of the PIN diode 120.

When the voltage is applied to the PIN diode 120 to be turned on, the meander lines 115 connected by the PIN diode 120 is short-circuited and thus the length of the radiator 110 of the antenna element 105 becomes the total length of the feeding part 111 and the meander line part 115. In contrast, when no voltage is applied to the PIN diode 120, the PIN diode 120 is turned off. At this time, the meander lines connected by the PIN diode 120 are open and the length of the radiator 110 of the antenna element 105 equals the length from the feeding part 111 to the meander line part 115 before the PIN diode 120.

Thus, depending on an ON state and an OFF state of the PIN diode 120, the length of the radiator 110 of the antenna element 105 can be adjusted. As in one exemplary embodiment of the present invention, when the PIN diode 120 is turned on, the length of the radiator 110 relatively lengthens. Thus, the MIMO antenna 101 can serve as a WLAN antenna of IEEE 802.11b standard, a Bluetooth antenna, or a WiBro service antenna. When the PIN diode 120 is turned off, the length of the radiator 110 relatively shortens and the MIMO antenna 101 can serve as a WLAN antenna of IEEE 802.11a standard.

As such, the MIMO antenna 1 or 101 can operate in the double service bands by mounting the PIN diode 20 or 120 on the antenna element 5 or 105 and reduce the size of the antenna element 5 or 105. In addition, its fabrication is simplified by forming the antenna element 5 or 105 on the circuit board 60 as the patch antenna.

In an exemplary embodiment, since the size of the antenna element 5 or 105 is merely 10.3 mm*8 mm, the total size of the MIMO antenna 1 or 101 is 10.3 mm*8 mm*2=162.4 $mm^2$. By contrast, a conventional dual band MIMO antenna disclosed in IEEE APS, Vol. 2A, 3-8 Jul. 2005 Page: 351-354, "Small dual band modified meander antenna with multiple elements" (hereafter, referred to as a literature 1), has two pairs of antenna elements and is 672 $mm^2$ in size which is twice as large as the MIMO antenna of the exemplary embodiment of the present invention. Additionally, another conventional MIMO antenna disclosed in IEEE APS, Vol. 4A, 3-8 Jul. 2005 Page: 234-246, "A novel wide band antenna for WLAN applications" operates in the double bands and thus reduces its size, compared with the literature 1. However, since this conventional MIMO antenna has a three-dimensional configuration, it requires a certain space. Its antenna size is 557 $mm^2$ which is almost twice as large as the MIMO antenna of the exemplary embodiment of the present invention.

In the exemplary embodiments of the present invention, the antenna is designed to operate in a double frequency band by mounting only one PIN diode 20 or 120 on the radiator 10 or 110. It is to be understood that the antenna can be designed to operate in multiple frequency bands by mounting a plurality of PIN diodes 20 or 120.

As set forth above, the MIMO antenna can operate in double service bands and also has a drastically reduced size.

While the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A multiple-input multiple-output (MIMO) antenna operable in a multiband, comprising:

a plurality of antenna elements each comprising a radiator which radiates electromagnetic waves, a ground connected to the radiator, and at least one switching element mounted in an area of a lengthwise direction of the radiator and short-circuiting or opening the area of the radiator, wherein the radiator comprises a feeding part formed in a long strip shape in a first direction of the radiator, and a plate-shaped radiating plate connected to a first end of the feeding part.

2. The MIMO antenna as in claim 1, wherein the radiation plate comprises a first radiation plate which is formed in a strip shape and is connected to the first end of the feeding part in a cross direction of the feeding part, and a second radiation plate which is formed in a rectangular shape and apart from the first radiation plate at an interval.

3. The MIMO antenna as in claim 2, wherein a first side of the first radiation plate and a first side of the second radiation plate are interconnected by the switching element, and short-circuited or opened according to one of an on state and an off state of the switching element.

4. The MIMO antenna as in claim 2, wherein, if the switching element is turned on to electrically short-circuit the first radiation plate and the second radiation plate, the radiator operates in a low frequency band compared to the off state of the switching element, and if the switching element is turned off to electrically open the first radiation plate and the second radiation plate, the radiator operates in a high frequency band compared to the on state of the switching element.

5. The MIMO antenna as in claim 1, wherein the switching element is a PIN diode.

6. The MIMO antenna as in claim 1, wherein a plurality of switching elements are arranged at intervals and extend in the lengthwise direction of the radiator.

7. The MIMO antenna as in claim 1, further comprising a plurality of grounds of the antenna elements, wherein the plurality of grounds form a single ground.

8. The MIMO antenna as in claim 1, wherein each of the antenna elements further comprise a plurality of radiators, wherein the radiators of the antenna elements are arranged at intervals.

9. The MIMO antenna as in claim 1, wherein the radiator is mounted on a first side of a circuit board, and the ground is mounted on a second side of the circuit board.

10. The MIMO antenna as in claim 1, wherein each of the antenna elements further comprise a plurality of switching elements, wherein the switching elements are turned on or off at the same time.

11. A multiple-input multiple-output (MIMO) antenna operable in a multiband, comprising:

a plurality of antenna elements each comprising a radiator which radiates electromagnetic waves, a ground connected to the radiator, and at least one switching element mounted in an area of a lengthwise direction of the radiator and short-circuiting or opening the area of the radiator, wherein the radiator comprises a meander line part which is bent in a zigzag pattern.

12. The MIMO antenna as in claim 11, wherein the switching element is mounted on a first side of the circuit board along the lengthwise direction of the meander line part, and the first side of the meander line part is short-circuited or opened according to the on state or the off state of the switching element.

13. The MIMO antenna as in claim 12, wherein, if the switching element is turned on to electrically short-circuit the first side of the meander line part, the radiator operates in a low frequency band compared to the off state of the switching element, and if the switching element is turned off to electrically open the one side of the meander line part, the radiator operates in a high frequency band compared to the on state of the switching element.

14. A multiple-input multiple-output (MIMO) antenna operable in a multiband, comprising:

a plurality of antenna elements each comprising a radiator which radiates electromagnetic waves, a ground connected to the radiator, and at least one switching element mounted in an area of a lengthwise direction of the radiator and shot-circuiting or opening the area of the radiator; and a switching controller which turns on the switching element by applying a voltage over a certain level to the switching element.

15. A multiple-input multiple-output (MIMO) antenna operable in a multiband, comprising:

a plurality of antenna elements each comprising a radiator which radiates electromagnetic waves, a ground connected to the radiator, and at least one switching element mounted in an area of a lengthwise direction of the radiator and short-circuiting or opening the area of the radiator, wherein a matching part is extended from the ground to a distance toward the radiator and is bent to one side.

16. The MIMO antenna as in claim 15, wherein the matching part is electrically connected to the first radiation plate through a via hole.

* * * * *